US010234104B2

(12) United States Patent
Maas

(10) Patent No.: US 10,234,104 B2
(45) Date of Patent: Mar. 19, 2019

(54) COLLAPSIBLE SUSPENDED LIGHTING SYSTEM

(71) Applicant: NBCUniversal Media, LLC, New York, NY (US)

(72) Inventor: Richard William Maas, Simi Valley, CA (US)

(73) Assignee: NBCUniversal Media, LLC, New York, NY (US)

( * ) Notice: Subject to any disclaimer, the term of this patent is extended or adjusted under 35 U.S.C. 154(b) by 0 days.

(21) Appl. No.: 13/798,608

(22) Filed: Mar. 13, 2013

(65) Prior Publication Data

US 2014/0268717 A1 Sep. 18, 2014

(51) Int. Cl.

| | |
|---|---|
| ***E06B 9/24*** | (2006.01) |
| ***F21S 2/00*** | (2016.01) |
| ***F21S 4/28*** | (2016.01) |
| ***E06B 9/386*** | (2006.01) |
| ***F21V 11/02*** | (2006.01) |
| ***F21Y 103/00*** | (2016.01) |
| ***F21Y 115/10*** | (2016.01) |

(52) U.S. Cl.

CPC ..... *F21V 11/02* (2013.01); *F21S 2/00* (2013.01); *F21S 4/28* (2016.01); *E06B 9/386* (2013.01); *E06B 2009/247* (2013.01); *F21Y 2103/00* (2013.01); *F21Y 2115/10* (2016.08)

(58) Field of Classification Search

CPC ..... E06B 2009/247; F21V 15/012; F21S 4/20
USPC ..... 160/127; 362/217.12, 217.13, 450, 555, 362/217.14, 249.09, 249.14, 249.15, 403, 362/225, 217.01, 249.08
See application file for complete search history.

(56) References Cited

U.S. PATENT DOCUMENTS 1,761,120 A * 6/1930 Graham et al. ..... 40/452
3,628,007 A * 12/1971 Rosenberg ..... 362/342
5,601,361 A * 2/1997 Lawrence ..... 362/238
(Continued)

FOREIGN PATENT DOCUMENTS

DE 102005032657 A1 * 2/2007 ..... E06B 9/386
FR 2847615 A1 * 5/2004 ..... E06B 9/386

OTHER PUBLICATIONS

Kino Flo, Operation Manual Blanket-Lite 6×6 DMX, Jan. 7, 2008, Kino Flo Lighting Systems, All Pages.*
(Continued)

*Primary Examiner* — Alexander K Garlen
*Assistant Examiner* — Colin J Cattanach
(74) *Attorney, Agent, or Firm* — Fletcher Yoder, P.C.

(57) ABSTRACT

A lighting system comprises a flexible support, such as a pair of fabric or web-like strips, and a plurality of tubular light sources supported by the flexible support. The flexible support may be hung from a support structure, and the tubular light sources will hang generally parallel to one another. Each tubular light source may include a plurality of LED chips, and power supply or conversion circuitry may also be disposed in the tubular light sources. Power cabling extends to the light sources, and may be adapted to provide pass-through power to other, similar assemblies to form a modular system. The assemblies may be easily deployed and repacked for storage and movement. The system is suitable for large area lighting, particularly with panels used for theater, television, and film sets, or with displays, trade show installations, and so forth.

26 Claims, 5 Drawing Sheets

(56) References Cited

U.S. PATENT DOCUMENTS 5,634,286 A * 6/1997 Johnson ..... 40/564
5,688,011 A * 11/1997 Gulley ..... B66C 1/18 294/74
5,967,644 A * 10/1999 Pan ..... 362/249.14
6,042,243 A * 3/2000 Grill ..... G09F 13/0413 362/125
D454,670 S * 3/2002 Weller ..... 119/795
6,601,634 B2 * 8/2003 Weidenbach ..... 160/166.1
6,908,131 B2 * 6/2005 Main ..... A61G 7/1023 294/150
7,513,644 B2 * 4/2009 Kufferath-Kassner et al. ..... 362/249.15
7,617,857 B2 * 11/2009 Froese ..... 160/10
8,172,426 B2 * 5/2012 Frey ..... 362/249.08
2004/0012959 A1 * 1/2004 Robertson ..... F21V 7/005 362/247
2007/0030678 A1 * 2/2007 Bedson et al. ..... 362/249
2007/0159413 A1 * 7/2007 Thorjussen et al. ..... 345/1.3
2007/0182666 A1 * 8/2007 Hochman et al. ..... 345/46
2008/0010878 A1 * 1/2008 Hansen et al. ..... 40/564
2008/0041533 A1 * 2/2008 Ziegler ..... 160/10
2008/0055106 A1 * 3/2008 Zhang ..... 340/815.45
2009/0067173 A1 * 3/2009 Kufferath-Kassner et al. ..... 362/249.15
2010/0302772 A1 * 12/2010 Lin ..... 362/231
2011/0096531 A1 * 4/2011 Frey ..... 362/97.4
2011/0126992 A1 * 6/2011 Yordanova ..... E06B 9/386 160/127
2011/0222276 A1 * 9/2011 Kasuya ..... 362/225
2012/0008315 A1 * 1/2012 Simon ..... F21V 21/005 362/217.13
2014/0078760 A1 * 3/2014 Rossini ..... 362/477
2014/0233225 A1 * 8/2014 Veilleux ..... F21V 19/0085 362/217.17
2015/0226391 A1 * 8/2015 Sellam ..... F21S 4/003 362/249.02

OTHER PUBLICATIONS

Ratchet Straps w/1 Flat Nylon Webbing, Sep. 25, 2008, Wayback Machine archive image; https://web.archive.org/web/20080925173826/http://www.strapworks.com/Ratchet_Straps_p/rs1n.htm.*

Kino Fio Blanket—Lite Product Detail, https://web.archive.org/web/20090123154326/http:/kinallo.com/Lighting%20fixtures%20with%20Remote%20ballast/Blanket%20Lite/Blanket-Lite.htm, 2006-2009, Kino Flo Incorporated, pp. 1-10.

Kino Flo Blanket—Lite Product Detail, https://web.archive.org/web/20060820164345/http://www.kinoflo.com/Lighting%20fixtures%20with%20Remote%20ballast/Blanket%20Lite/Blanket-Lite.htm, 2006-2009, Kino Flo Incorporated, p. 1.

* cited by examiner

COLLAPSIBLE SUSPENDED LIGHTING SYSTEM

BACKGROUND

The present invention relates to a routing system of the type used for both primitive and temporary displays, sets, installations, and so forth wherein a light source is placed behind a panel or other transparent or translucent medium.

In the field of lighting systems, particularly those used for theater, television, film, and other sets, trade shows, building and outdoor displays, and the like, certain known and reliable systems have been used for many years. For example, a backdrop is commonly used, which may comprise a rigid or flexible panel on which graphics or pictures are printed. Such panels may be hung behind a scene or set. In other applications, such as tradeshows, posters and panels may be hung or mounted in various locations in a display structure or installation. In theater, television, and film lighting, lights and systems that are sometimes referred to as "sky pans", "cyclorama or cyc lights" or floodlights may be disposed behind the panel, and powered to illuminate all or a portion of the panel. In many applications the panel is transparent or translucent to allow the graphics or image to be brightly illuminated by the backlighting. Such lighting is generally quite effective, but has definite drawbacks. For example, sky pan lights may need to be placed as much as 10 to 12 feet behind the panel. Moreover, depending upon the size of the light and the area illuminated, power ratings may range to approximately 4 kA or higher. The resulting lighting is thus hot, energy intensive, and space-consuming.

Moreover, such lighting systems are somewhat difficult to handle and tedious to displace and store after use or between uses. Where periodic changes are made to scenes or backdrops, or where the entire application may need to be moved to another location, current lighting systems must be carefully packed, along with supporting cords and structures, moved to a storage or new location, and carefully unpacked and set up. The systems tend to be large and heavy, making all of these operations more difficult.

There is a need, in this field, for improvements in lighting systems and methods that may at least partially address the drawbacks of current technologies.

BRIEF DESCRIPTION

The present disclosure sets out a new form or lighting system designed to respond to such needs. The system may include a flexible support configured to be suspended from a support structure, a plurality of tubular light sources held generally horizontally and parallel to one another by the flexible support, and electrical cabling coupled to the plurality of light sources to provide power to the light sources during operation.

In accordance with other aspects, the system may include a plurality of tubular light sources arranged in a ladder-like arrangement and held generally horizontally and parallel to one another by a flexible support that is configured to be suspended from a support structure during use, and collapsed for storage or movement. Electrical cabling is coupled to the plurality of light sources to provide power to the light sources during operation, the cabling comprising a first connector adjacent to a first point of the lighting system and configured to receive incoming power for the tubular light sources, and a second connector adjacent to a second point of the lighting system and configured to allow power to be passed along to another lighting system.

In accordance with still further aspects, the lighting system may comprise a plurality of modular lighting assemblies. Each modular lighting assembly comprises a plurality of tubular light sources arranged in a ladder-like arrangement and held generally horizontally and parallel to one another by a flexible support that is configured to be suspended from a support structure during use, and collapsed for storage or movement. Electrical cabling is coupled to the plurality of light sources to provide power to the light sources during operation. The cabling comprises a first connector adjacent to a first point of the lighting system and configured to receive incoming power for the tubular light sources from a power source or from another of the modular lighting assemblies, and a second connector adjacent to a second point of the lighting system and configured to allow power to be passed along to another of the modular lighting assemblies.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
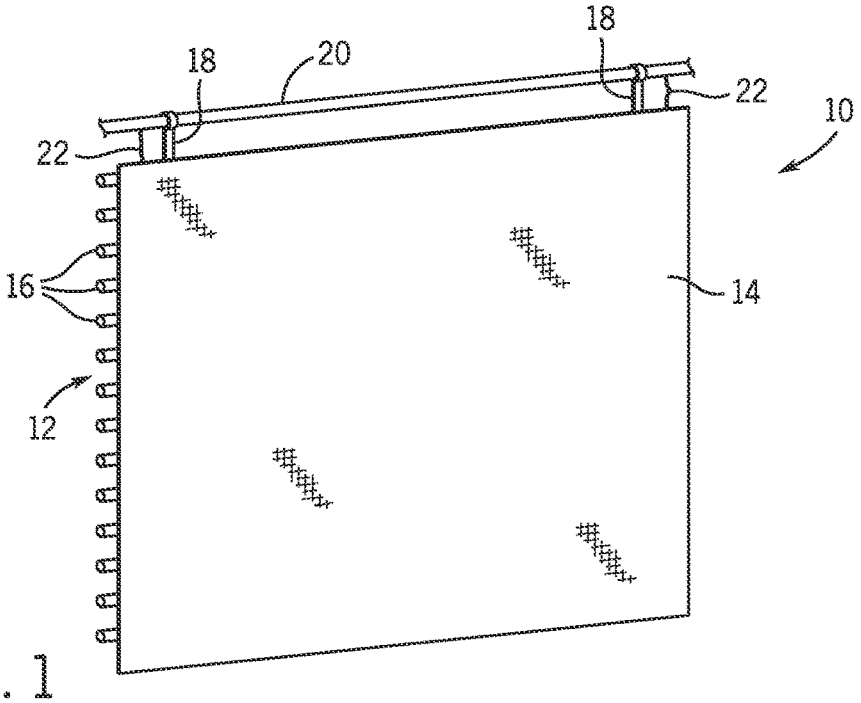
FIG. 1 is an illustration of exemplary set or display lit in accordance with aspects of the present techniques.

Turning now to the drawings, FIG. 1 illustrates a lighting system 10 that may be suitable for applications such as television and theater sets, film sets, tradeshows, and any one of the range of permanent, semi-permanent and temporary settings. In the illustrated embodiment a light assembly 12 is disposed behind a panel 14. The panel may be transparent or translucent, and may have components, graphics, scenes, or any desired feature drawn, applied, printed, painted or otherwise disposed on one or both sides thereof. The panel may also be colored or formed so as to provide any desired effect when light traverses or falls on the panel from the light assembly 12. The light assembly itself includes a series of parallel light tubes 16, in this case arranged horizontally behind the panel. As discussed in more detail below, each of the light tubes may comprise a series of light emitting diodes that create and project light towards the panel when powered. The light source or sources within the tubes may be powered by one or more circuits (e.g., transformers, drive circuits, power converters, etc.) either within the tubes or external to the tubes. The light tubes are supported on a flexible support structure indicated generally by reference numeral 18. In the embodiment illustrated in FIG. 1, two flexible supports extend upwardly from the light assembly and may be secured to a mechanical support 20, such as a bar over which the flexible support structures pass. Also visible in FIG. 1 is one or more power cables or harnesses 22 that allow for application of power to the light tubes.

Figure 2:
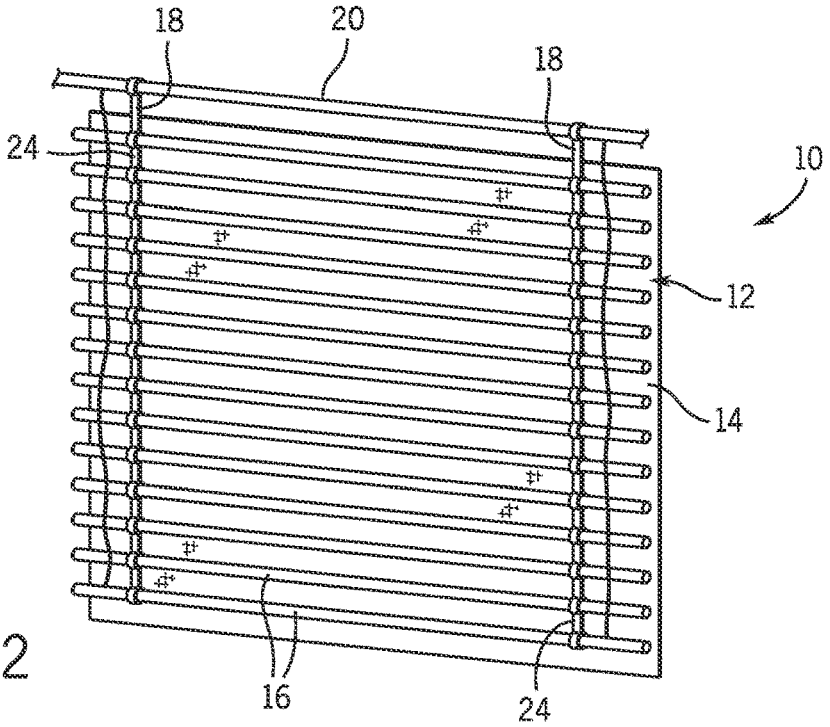
FIG. 2 is a diagram of the same display from a rear side.

The same structure is illustrated in FIG. 2 from a rear side. As noted above, the light assembly 12 comprises a series of light tubes 16 supported in a parallel arrangement by a flexible support structure 18. The panel 14 is placed adjacent to the light assembly and light from the assembly shines onto the panel as described more fully below. In the illustrated embodiment the flexible support structure comprises flexible vertical components that receive and support light tubes. These elements may be made of fabric, webbing, or any suitable flexible (i.e., collapsible) material, or a series of segments that can be easily hung and collapsed. Moreover, these elements of the support structure may include pockets that receive and support the light tubes, parallel webs with bridge-type members that are disposed under the light tubes, slots through which the light tubes pass, or any other suitable support. Effectively, then, the light assembly 12 is a hanging structure that is held by the bar 20 or any suitable upper mechanical support, with the light tubes being positioned in the flexible support structure 18 and held in place, in the generally parallel arrangement by gravity. One or more weights or other lower supports could also be used to maintain the system taut or stable once deployed. Accordingly, the entire arrangement is fully flexible, collapsible, easily packaged, and so forth as discussed below. In the currently contemplated embodiment, the power cables or harnesses provide power to the light tubes and may terminate in one or more corners of the light assembly with a male and/or female connector. For example, in a currently contemplated embodiment, at a lower corner of the light assembly a male electrical plug is provided that can be plugged into a grid outlet or extension cord (or other power source). Moreover, a female receptacle may be provided at a corner of the light assembly and coupled to the power cable so that power may be passed to one or more other light assemblies in a pass-through manner as discussed below.

Figure 3:
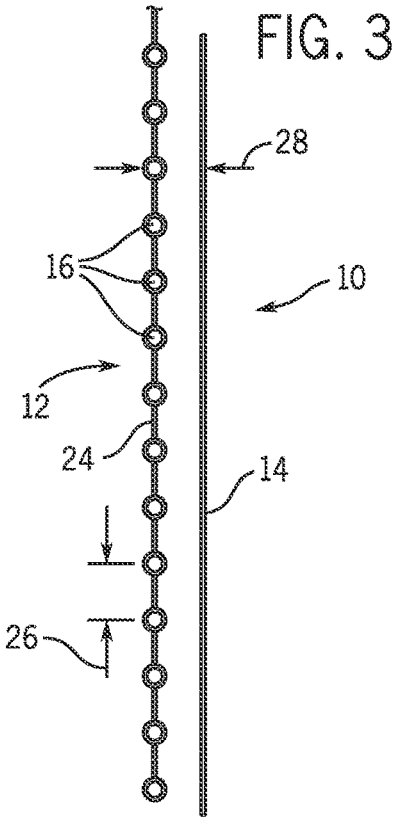
FIG. 3 is a side view of the display illustrating a front panel and a rear light assembly in accordance with aspects of the present techniques.

FIG. 3 is a side view of the light assembly and panel of the previous figures. The light system 10 here again includes the light assembly 12 disposed adjacent to the lit panel 14. In general, as discussed above, the light assembly will be placed in back of the panel 14, although in some embodiments similar light assemblies may be placed in front of, between, on top of or below similar panels, or in various curved configurations with respect to the panels. As mentioned above, the light assembly may form a module that may be used singly or with other similar modular light assemblies. In this modular approach, while the light assemblies may be different, they are conveniently identical, having the same number of light tubes and dimensions. In the illustrated embodiment, for example, 14 parallel light tubes are provided at equal spacings as indicated by reference numeral 26 in FIG. 3. Typical spacings may be, for example, between 6 inches and 12 inches. Unlike conventional high powered spotlights, moreover, the light assembly may be placed relatively close to the panel as indicated by dimension 28 in FIG. 3. By way of example, in currently contemplated embodiments, the light assembly is placed between 6 inches and 24 inches from the panel (rather than distances on the order of 4 to 8 feet for conventional lighting systems).

Figure 4:
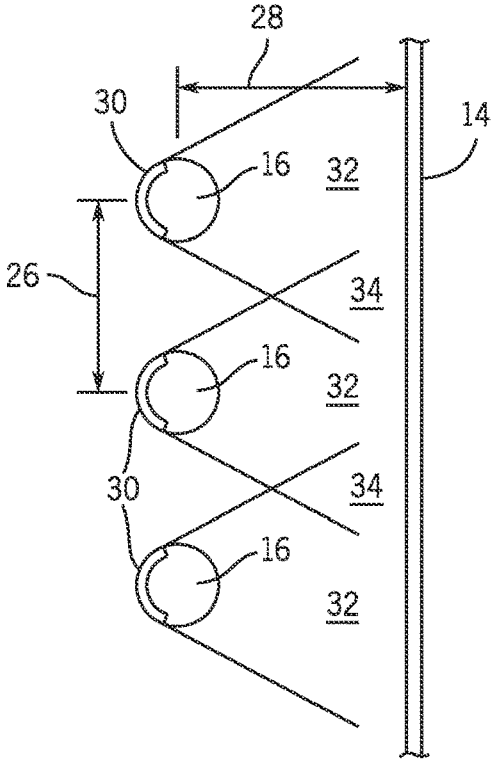
FIG. 4 is a diagrammatical representation of a series light tubes used in the system, illustrating exemplary physical configurations and arrangements for lighting a panel.

FIG. 4 is a detailed illustration of exemplary spacing and illumination by the light tubes. As noted above, while any suitable light tube may be employed, in currently contemplated embodiments each light tube comprises a cluster of light emitting diode (LED) chips (not separately shown) with a backing 30. The LED chips are configured so that light is effectively directed toward a forward face of the light tube. In the light tubes used in current embodiments, one or more electrical circuits are provided for converting AC power fed to the power cable to DC power for the individual light chips. These light chips may be designed to be powered, for example by 12 or 24 vDC, although any suitable power rating may be employed. Suitable light tubes may be obtained, for example, from Mac Tech LED under the designation TL6036WW. Moreover, the light tubes used in present embodiments have a luminous flux rating of approximately 3200k lumen and a beam angle of approximately 120 degrees.

As shown in FIG. 4, the spacing 26 between the light tubes, along with the spacing 28 between the light assembly and the panel 14 preferably allow for some degree of overlap between the illuminated regions 32 of each light tube. That is, to provide even and consistent lighting of the panel, each light tube emits a region of illumination 32 that overlaps in adjacent area 34 as they approach the panel. In presently contemplated embodiments the overlap may comprise the full or nearly full combination of two adjacent light tubes, or more than two light tubes may contribute to overlapping regions.

Figure 5:
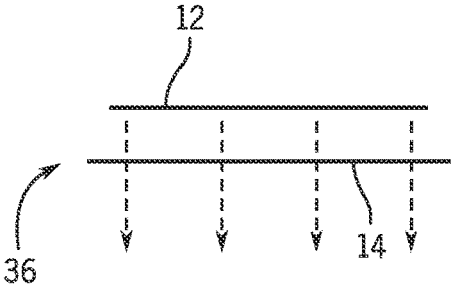
FIGS. 5-11 are diagrammatical representations of different modular configurations in which the light assemblies may be used.
Figure 6:
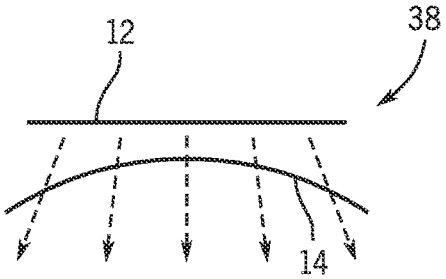
Figure 7:
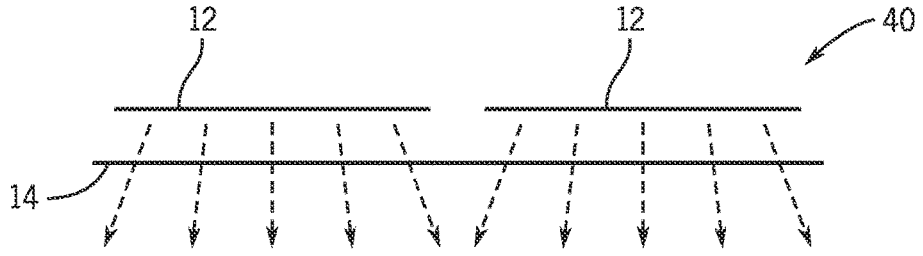
Figure 8:
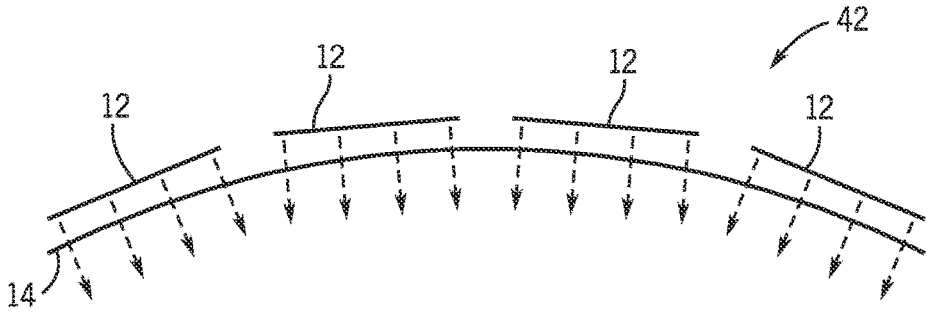

FIGS. 5-11 illustrate diagrammatically a series of embodiments in which the lighting system is used in a modular fashion with different arrangements of panels, typically for different settings and sizes. FIG. 5, for example, shows a single modular arrangement with a flat panel. This simple arrangement, designated by reference numeral 36, corresponds to the embodiments of FIGS. 1 and 2. In FIG. 6, a curved arrangement 38 includes a panel 14 that is arched or curved with respect to the light assembly. This curve could be convex with respect to the light assembly as shown in FIG. 6 or concave, or the panel could be arranged in a wavy fashion. FIG. 7 illustrates a modular arrangement 40 in which two light assemblies 12 are used to light a single panel 14. As noted above, in such arrangements, the light assemblies may be identical to one another in size, configuration, and lighting capacity, or could be different. FIG. 8 shows a similar but larger arrangement 42 in which a series of four light assemblies are used to light a large curved panel.

Figure 9:
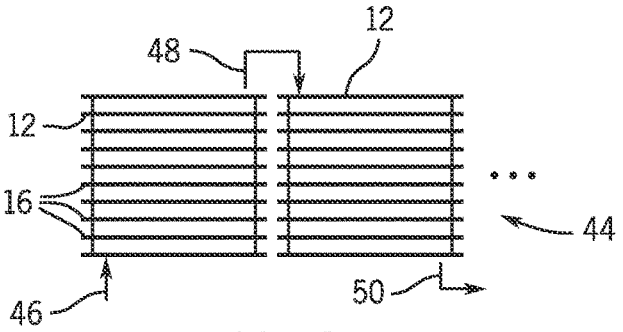
Figure 10:
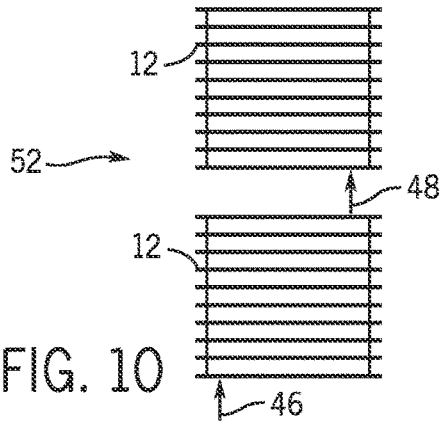
Figure 11:
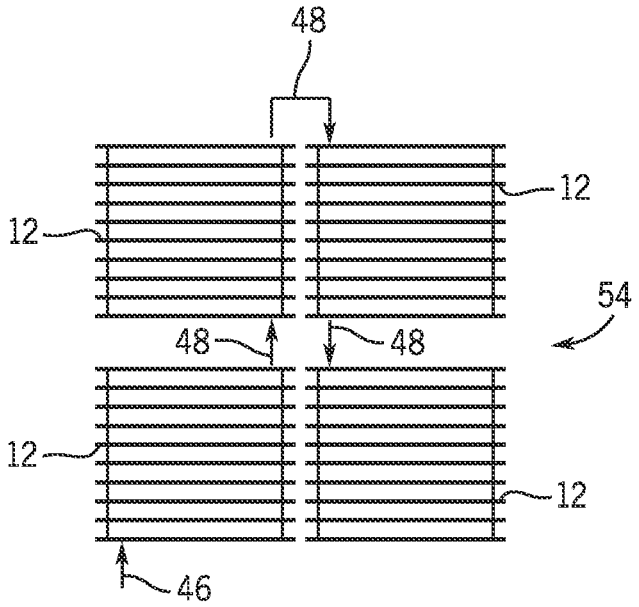

FIGS. 9, 10 and 11 show various ways in which modular panels may be interconnected to facilitate installation and powering. In FIG. 9, a side-by-side arrangement 44 comprises two identical light assemblies 12. Power supplied at a lower corner of a first light assembly as indicated by reference numeral 46 (e.g., via a male plug as discussed above) and at an upper corner of the same panel power is transmitted to an adjacent panel as indicated by reference numeral 48. This may be accomplished, for example, by a female connector at the top of the first panel that joins a male connector at the top of the second. In this same arrangement, a lower connector may be provided for passing power through a subsequent panel, as indicated by reference numeral 50. It should be noted, however, that the placement and type of electrical connections may be varied, and these may be provided along the top, bottom, mid-points, or at any suitable location in the light assembly.

FIG. 10 illustrates a similar arrangement in which two panels 12 are provided in upper and lower positions. Here again, power is received in a first panel as indicated at reference numeral 46, and is passed to a second panel by an interconnection 48. In FIG. 11 a matrix or array of light assemblies is provided, with incoming and interconnecting power as discussed above. It should be noted that in upper and lower, and matrix-type arrangements, the support structures of the light tubes may be such that one entire light assembly may be simply hung onto an upper light assembly without additional mechanical supports being required.

Figure 12:
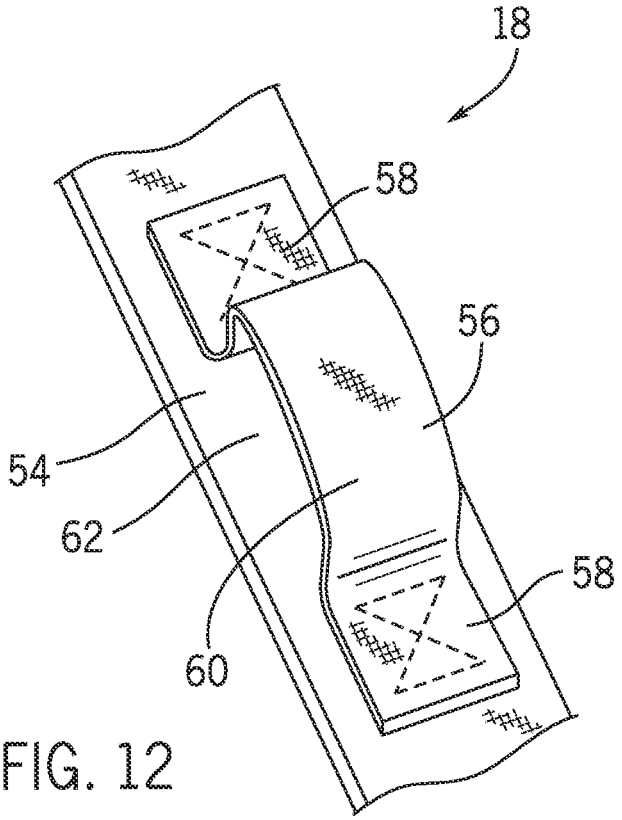
FIGS. 12 and 13 are detailed views of an exemplary arrangement for holding and orienting light tubes in a collapsible assembly.
Figure 13:
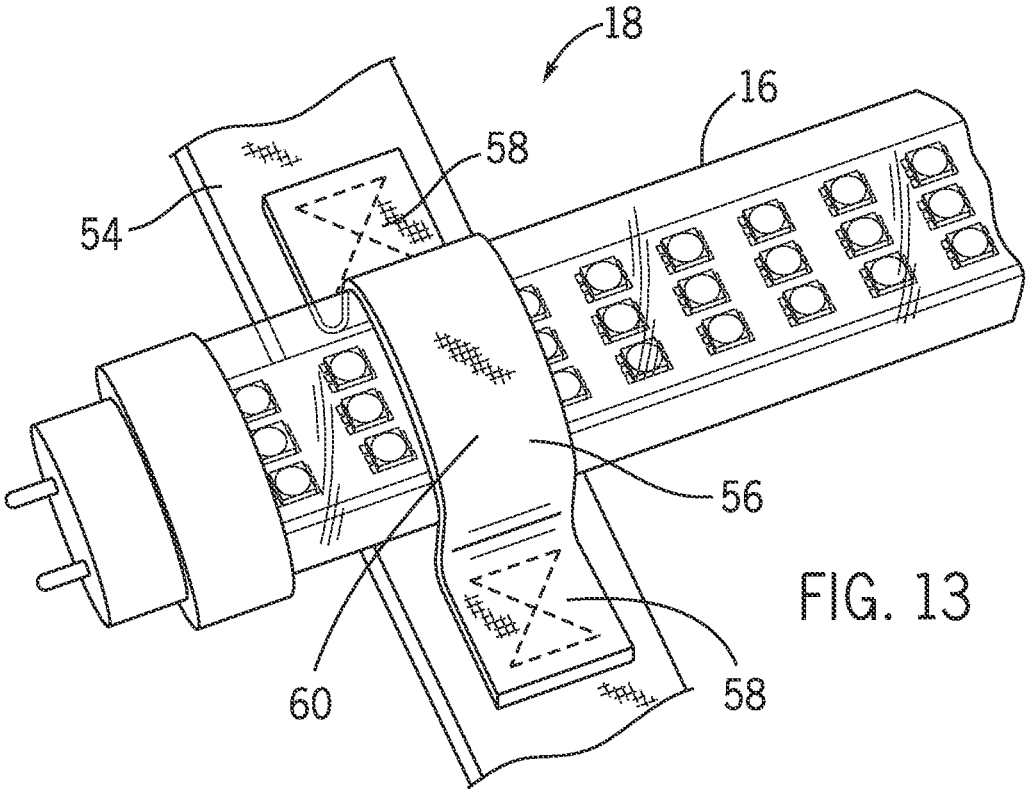

In presently contemplated configurations, the light tube support structure 18 is made of webbing material with loops to receive and secure the light tubes as generally illustrated in FIGS. 12 and 13. As shown in FIG. 12, a length of webbing 54 has loops 56 secured to a face, such as via stitching 58. The webbing may be made of any suitable material, such as a durable fabric. The loops 56 may be made of the same or another material, but in a present embodiment, they are made of an elastic fabric. A loop portion 60 forms an opening 62 through which the light tubes may be inserted, as shown in FIG. 13. The resulting structure will not only hold the light tubes in place, but will provide a secure orientation of the tubes so that the light sources within each tube will remain properly directed as described above. It has been found that tension on the webbing and loops as the system is raised into position aids at securely holding and orienting the light tubes.

Figure 14:
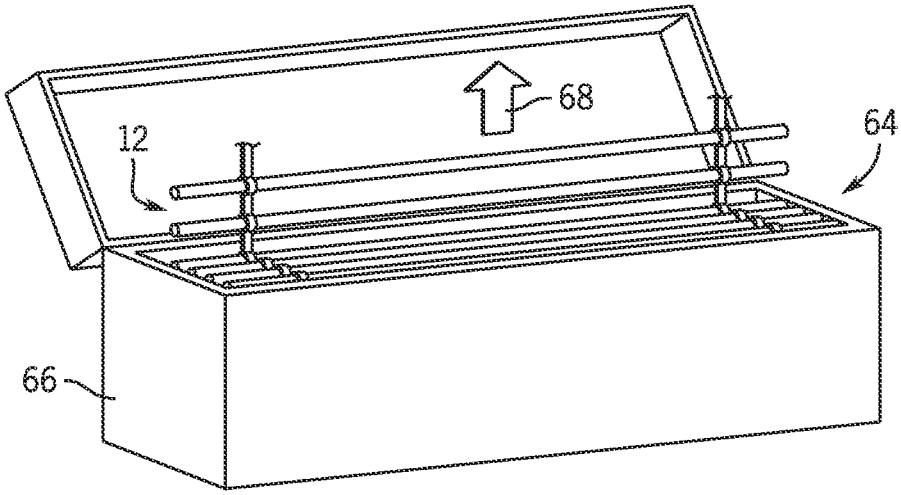
FIG. 14 is an illustration of a straightforward manner in which the lighting system may be packed and unpacked for storage and relocation.

As noted above, the lighting system allows for easily collapsing the entire flexible structure for disassembly, storage and transport. As illustrated in FIG. 14, for example, one or more of the light assemblies may be positioned in a collapsed arrangement 64 within a storage or transport crate or trunk 66. The entire assembly will then be self-contained, and could be extracted, mounted and used following very straightforward removal as indicated by arrow 68 in FIG. 14. In presently contemplated embodiments, all circuitry and power cabling is pre-assembled in the light assembly, as discussed above, so that take-down and set-up are greatly facilitated. Moreover, importantly, rather than the complex special shipping arrangements required for transport of conventional lighting systems, the collapsible structure described allows for much smaller and simple packaging that can be transported more compactly and via commercial carriers.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lighting system, comprising:

a flexible support configured to be suspended from a support, the flexible support comprising at least two independent members, wherein the at least two independent members do not contact one another;

a plurality of tubular light sources held substantially parallel to one another by the at least two independent members, each of the plurality of tubular light sources comprising:

one or more light emitting elements;

a tube encompassing the one or more light emitting elements; and a backing disposed in or on the tube, wherein the backing is configured to block light emitted from the light emitting elements from passing through a rear portion of the tube;

electrical cabling coupled to the plurality of light sources to provide power to the light sources during operation;

wherein:

a first independent member of the at least two independent members consists of a first strap with:

first and second ends that are end-most portions of the first independent member that terminate the first independent member, wherein the first end terminates at the support and the second end is indirectly supported by the support without any additional direct support other than the first strap; and first intermediate portions, wherein:

the first intermediate portions of the first independent member are configured to directly support a first portion of each of the plurality of tubular light sources, and only the first end is configured to be directly supported by the support and the second end is indirectly supported by the support and is detached from any support, when fully deployed;

a second independent member of the at least two independent members consists of a second strap with:

third and fourth ends that are end-most portions of the second independent member that terminate the second independent member wherein the third end terminates at the support and the fourth end is indirectly supported by the support without any additional direct support other than the second strap; and second intermediate portions, wherein:

the second intermediate portions of the second independent member are configured to directly support a second portion of each of the plurality of tubular light sources, and only the third end is configured to be directly supported by the support and the fourth end is indirectly supported by the support and is detached from any support, when fully deployed;

a third portion of each of the plurality of tubular light sources is between the first portion of each of the plurality of tubular light sources and the second portion of each of the plurality of tubular light sources; and the third portion of each of the plurality of tubular light sources is not directly supported by the first independent member or the second independent member.

2. The lighting system of claim 1, wherein the lighting system is configured to be collapsed for storage and extended for deployment, wherein tension on one or more loop portions of the at least two independent members created by extending the at least two independent members is configured to secure the plurality of tubular light sources to the flexible support.

3. The lighting system of claim 2, wherein the at least two independent members comprise a fabric or webbing and wherein the tension is configured to aid in orienting the plurality of tubular light sources.

4. The lighting system of claim 1, wherein the one or more light emitting elements each comprise one or more LED chips.

5. The lighting system of claim 4, wherein the tubular light sources each comprise power conversion circuitry for powering the LED chips.

6. The lighting system of claim 1, wherein the lighting system is configured to be placed at a distance from a back-illuminated panel of between approximately 6inches and 24 inches creating overlapping regions of light from the tubular light sources as the light approaches the back-illuminated panel.

7. The lighting system of claim 1, wherein the tubular light sources are substantially evenly spaced from one another.

8. The lighting system of claim 7, wherein the tubular light sources are spaced from one another by between approximately 6 inches and approximately 12 inches.

9. The lighting system of claim 1, wherein the lighting system comprises electrical cabling that comprises a first end adjacent to a first point of the lighting system and configured to receive incoming power for the tubular light sources.

10. The lighting system of claim 9, wherein the electrical cabling comprises a second end adjacent to a second point of the lighting system and configured to allow power to be passed along to another lighting system.

11. The lighting system of claim 10, wherein the first and second points are adjacent to corners of the lighting system.

12. A lighting system, comprising:

a plurality of light tubes arranged and held substantially parallel to one another by a flexible support that is configured to be suspended from a support in a deployed configuration, and collapsed into a collapsed configuration for storage or movement, the flexible support comprising at least first and second independent members, wherein the at least first and second independent members do not contact one another, wherein:

the first independent member consists of a first strap consisting of:

a first intermediate portion with one or more first openings that each directly hold a first portion of one of the plurality of light tubes; and first and second ends that are end-most portions of the first strap that terminate the first independent member, wherein only the first end is configured to be directly supported by and terminates at the support and the second end is configured to be indirectly supported by the support without any additional direct support other than the first strap, wherein the second independent member consists of a second strap consisting of:

a second intermediate portion with one or more second openings that each directly hold a second portion of one of the plurality of light tubes; and third and fourth ends that are end-most of the second strap that terminate the second independent member, wherein only the third end is configured to be directly supported by and terminates at the support and the fourth end is configured to be indirectly supported by the support without any additional direct support other than the second strap, and wherein a third portion of each one of the plurality of light tubes is between the first portion and the second portion of each one of the plurality of light tubes and is not directly supported by the first independent member or the second independent member; and electrical cabling coupled to the plurality of light tubes to provide power to the light tubes during operation, the electrical cabling comprising a first connector adjacent to a first point of the lighting system and configured to receive incoming power for the light tubes, and a second connector adjacent to a second point of the lighting system and configured to allow power to be passed along to a second lighting system.

13. The lighting system of claim 12, wherein the flexible support, from the first end to the second end, is linearly extended into a fully deployed configuration using only a gravitational force to cause the plurality of light tubes to be arranged and held parallel to one another.

14. The lighting system of claim 13, wherein the first and second independent members comprise a fabric or webbing.

15. The lighting system of claim 12, wherein the light tubes each comprise:

an outer tube; and a plurality of LED chips, wherein the outer tube encompasses the plurality of LED chips and is configured to allow light to pass from the plurality of LED chips through a surface of the outer tube.

16. A lighting system, comprising:

a plurality of modular lighting assemblies, each modular lighting assembly comprising:

a plurality of light tubes arranged and held substantially parallel to one another by a flexible support that is configured to be suspended from a support during use, and collapsed for storage or movement, wherein each of the flexible supports for a particular modular lighting assembly of the plurality of modular lighting assemblies is independent from the flexible supports of the other modular lighting assemblies of the plurality of modular lighting assemblies, wherein the flexible support comprises at least first and second independent members, wherein the at least first and second independent members do not contact one another, wherein:

the first independent member consists of:

a first strap with:

first and second ends that are end-most portions of the first independent member that terminate the first independent member, wherein only the first end is configured to be directly supported by and terminates at the support and the second end is configured to be indirectly supported by the support without any additional direct support other than the first strap, when fully deployed; and first intermediate portions on the strap configured to directly support a first portion of each one of the plurality of light tubes;

the second independent member consists of:

a second strap with third and fourth ends that are end-most portions of the second independent member that terminate the second independent member, wherein only the third end is configured to be directly supported by and terminates at the support and the fourth end is configured to be indirectly supported by the support without any additional direct support other than the second strap, when fully deployed; and second intermediate portions on the strap configured to directly support a second portion of each one of the plurality of light tubes; and a third portion of each one of the plurality of light tubes is between the first and second portions of each one of the plurality of light tubes and is not directly supported by the first independent member or the second independent member; and electrical cabling coupled to the plurality of light tubes to provide power to the light tubes during operation, the electrical cabling comprising:

a first connector adjacent to a first point of the particular modular light assembly and configured to receive incoming power for the light tubes corresponding to the particular modular light assembly of the plurality of modular light assemblies from a power source or from another of the modular lighting assemblies, and a second connector adjacent to a second point of the particular modular light assembly and configured to allow power to be passed along to another of the modular lighting assemblies.

17. The lighting system of claim 16, wherein the first independent member is configured to directly support a first portion of a tube casing of each one of the plurality of light tubes, and the second independent member is configured to directly support a second portion of the tube casing for each one of the plurality of light tubes.

18. The lighting system of claim 16, wherein the plurality of modular lighting assemblies are configured to illuminate a single curved surface illumination panel that spans an illuminated area of the plurality of modular lighting assemblies, during operation.

19. The lighting system of claim 16, wherein the plurality of light tubes comprise one or more LED chips encompassed by a tube casing, wherein the tube casing is configured to allow light to pass from the one or more LED chips through a surface of the tube casing.

20. The lighting system of claim 16, wherein the modular lighting assemblies are substantially identical.

21. A lighting system comprising:

a first flexible support structure consisting of:

1) a first flexible, elongate fabric strip having a first end that is a first end-most portion of the first flexible, elongate fabric strip that terminates the first flexible support structure and a second end that is a second end-most portion of the first flexible, elongate fabric strip that terminates the first flexible support structure, the first end configured for attaching to a rigid support bar and the second end configured for being indirectly supported by the support without any additional direct support other than the first flexible, elongate fabric strip, when fully deployed, and 2) a first plurality of light holders disposed along the length of the first fabric strip, the first plurality of light holders comprising a first light holder configured to encircle and grip a first portion of a first light tube and a second light holder configured to encircle and grip a first portion of a second light tube;

a second flexible support structure consisting of:

1) a second flexible, elongate fabric strip having a first end that is a first end-most portion of the second flexible, elongate fabric strip that terminates the second flexible support structure and a second end that is a second end-most portion of the second flexible, elongate fabric strip that terminates the second flexible support structure, the first end configured for attaching to the rigid support bar and the second end configured for being indirectly supported by the support without any additional direct support other than the second flexible, elongate fabric strip, when fully deployed, and 2) a second plurality of light holders disposed along the length of the second fabric strip, the second plurality of light holders comprising a third light holder configured to encircle and grip a second portion of the first light tube and a fourth light holder configured to encircle and grip a second portion of the second light tube; and electrical cabling for providing power to the first and second light tubes, wherein:

the first light holder that is configured to encircle and grip the first portion of the first light tube is separate, spaced apart and not in direct contact with the third light holder that is configured to encircle and grip the second portion of the first light tube, and the second light holder that is configured to encircle and grip the first portion of the second light tube is separate, spaced apart and not in direct contact with the fourth light holder that is configured to encircle and grip the second portion of the second light tube.

22. The lighting system of claim 21, wherein the first fabric strip is not in direct contact with the second fabric strip.

23. The lighting system of claim 21, wherein:

the first light holder comprises a third fabric strip having a first end and a second end, wherein the first end of the third fabric strip is secured to a face of the first fabric strip, the second light holder comprises a fourth fabric strip having a first end and a second end, wherein the first end of the fourth fabric strip is secured to the face of the first fabric strip, the third light holder comprises a fifth fabric strip having a first end and a second end, wherein the first end of the fifth fabric strip is secured to a face of the second fabric strip, and the fourth light holder comprises a sixth fabric strip having a first end and a second end, wherein the first end of the sixth fabric strip is secured to a face of the second fabric strip.

24. The lighting system of claim 23, wherein:

the second end of the third fabric strip is secured to the face of the first fabric strip, the second end of the fourth fabric strip is secured to the face of the first fabric strip, the second end of the fifth fabric strip is secured to the face of the second fabric strip, and the second end of the sixth fabric strip is secured to the face of the second fabric strip.

25. The lighting system of claim 21, wherein:

the first light holder comprises a first elastic loop, the second light holder comprises a second elastic loop, the third light holder comprises a third elastic loop, and the fourth light holder comprises a fourth elastic loop.

26. The lighting system of claim 21, wherein:

the first light holder consists of a third fabric strip comprising a first set of securing ends that secure the third fabric strip to a face of the first fabric strip, wherein the third fabric strip forms a first loop portion with a first opening through which the first end of the first tube of the first light tube is gripped, the second light holder consists of a fourth fabric strip comprising a second set of securing ends that secure the fourth fabric strip to the face of the first fabric strip, wherein the fourth fabric strip forms a second loop portion with a second opening through which the first end of the second tube of the second light tube is gripped, and the third and fourth fabric strips are spaced apart and not in direct contact with each other.

* * * * *